US006365110B1

(12) United States Patent
Rainin et al.

(10) Patent No.: US 6,365,110 B1
(45) Date of Patent: Apr. 2, 2002

(54) BLOWOUT SPRINGLESS MANUAL AIR DISPLACEMENT PIPETTE WITH MECHANICAL ASSIST FOR AIDING IN LOCATING AND MAINTAINING PIPETTE PLUNGER AT A HOME POSITION

(75) Inventors: Kenneth Rainin, Piedmont; William D. Homberg, Oakland, both of CA (US)

(73) Assignee: Rainin Instrument, Emeryville, CA (US)

( * ) Notice: Subject to any disclaimer, the term of this patent is extended or adjusted under 35 U.S.C. 154(b) by 0 days.

(21) Appl. No.: 09/522,256

(22) Filed: Mar. 9, 2000

(51) Int. Cl.[7] ..... B01L 3/02

(52) U.S. Cl. ..... 422/100; 73/864.13; 73/864.16; 73/864.18

(58) Field of Search ..... 422/100; 73/864.01, 73/864.11, 864.13, 864.16, 864.18

(56) References Cited

U.S. PATENT DOCUMENTS 4,041,764 A * 8/1977 Sabloewski et al.
5,111,703 A * 5/1992 Allen
5,364,596 A * 11/1994 Magnussen, Jr. et al.
5,700,959 A * 12/1997 Homberg
5,792,424 A * 8/1998 Homberg et al.

* cited by examiner

*Primary Examiner*—Jan Ludlow
(74) *Attorney, Agent, or Firm*—Robert R. Meads

(57) ABSTRACT

A blowout springless manual air displacement pipette including a mechanical assist for generating a mechanical force opposing a return spring force on a plunger unit to aid a pipette user in locating and maintaining the plunger unit at a "home" position within a pipette body and ready for immersion of a pipette tip in a liquid to be drawn into the tip.

5 Claims, 4 Drawing Sheets

BLOWOUT SPRINGLESS MANUAL AIR DISPLACEMENT PIPETTE WITH MECHANICAL ASSIST FOR AIDING IN LOCATING AND MAINTAINING PIPETTE PLUNGER AT A HOME POSITION

BACKGROUND

The present invention relates to manual air displacement pipettes and more particularly to an improved manual pipette including a moveable plunger and a mechanical assist for aiding a pipette user in manually locating and maintaining the plunger at a "home" position ready to aspirate a predetermined volume of liquid.

U.S. Pat. Nos. 3,827,305 and 4,909,991, for example, describe commercially available single channel manual air displacement pipettes. Each such pipette includes an elongated hand-holdable pipette body housing an upwardly spring biased plunger unit. The plunger unit is supported for axial movement in the pipette body between a first or upper stop position in which an end portion of the plunger unit extends from an upper end of the pipette body. A pipette user grips the pipette body with his or her thumb over the exposed end of the plunger unit. Downward thumb action on the plunger unit moves the plunger unit downward from its upper stop position against the upward bias of a return spring to a second or a lower stop position at which all fluid is expelled from a tip secured to the pipette. Adjacent the lower stop position is a "home" position for the plunger unit to which the plunger unit is returned by the pipette user at the beginning of each aspiration operation with the pipette.

In the commercially available pipettes described in the foregoing patents, the home position is defined by a "soft" stop. As described in such patents, the soft stop comprises a second relatively stiff spring mechanism within the pipette body which is activated when the plunger unit reaches the home position. In this regard, and as depicted in FIG. 4*a* herein, as the pipette user manually moves the plunger unit from its upper stop position by pressing downwardly with his or her thumb on the exposed end of the plunger unit, the pipette user can "feel" an increased resistance to movement of the plunger unit associated with an activation of the second spring assembly opposing further downward movement of the plunger unit. The position of the plunger unit where the user feels the activation of the second spring mechanism defines the home position for the plunger unit. Continued movement of the plunger unit beyond the home position to the lower stop position is resisted by a combination of the return spring and the second spring mechanism.

Thus, in pipeting liquids with such commercially available pipettes, the pipette user grasps the pipette housing with his or her thumb on top of the exposed end of the plunger unit. Exerting downward thumb pressure on the plunger unit, the user moves the plunger unit away from the upper stop position against the force of the return spring. The user detects the home position for the plunger unit during movement of the plunger unit away from the first stop position by sensing the start of an increase in the downward force required to move the plunger unit. Such increase force is the result of movement of the plunger unit against the return spring and the second spring mechanism, commonly referred to as a "blowout" spring mechanism. Accurate sensing of the start of the increase in the downward force required to move the plunger unit is a delicate operation requiring great care to be exercised by the pipette user. Thus, with his or her thumb on top of the exposed end of the plunger unit, the user very carefully senses and then manually maintains the plunger unit at the home position. In practice, a significant portion of the total time associated with a pipeting operation is occupied by the pipette user manually maintaining the plunger unit at the home position ready for insertion of a tip extending from the pipette into the liquid which is to be aspirated by the pipette. Then, with the tip inserted in the liquid, the user manually controls the rate of return of the plunger unit from the home position to the upper stop position.

For accuracy and repeatability of operation of the pipette, it is important that the pipette user always bring the plunger unit to the exact same home position and that the pipette user manually control the rate of return of the plunger unit to the upper stop position in a repeatable manner for each pipette operation. This is necessary in order that the same desired volume of liquid will be drawn into the pipette tip during each repeated operation. It should be appreciated that such manual operation of a pipette places substantial physical and mental strain upon the pipette user over the course of a series of pipette operations wherein repeatability of operation is essential. In extreme cases, the physical hand and wrist strain associated with extensive and prolonged manual pipette operation can contribute to or produce repetitive strain injuries such as tendinitis and carpel tunnel syndrome.

Similar physical and mental stress problems are associated with other manual pipettes which include different mechanisms for defining the plunger unit home position. Examples of such different mechanisms are described in U.S. Pat. No. 4,041,764 and in German patent applications 239 539 A1 and 239 540 A1. Specifically, U.S. Pat. No. 4,041,764, describes a magnetic detent which is engaged between an upper stop and the pipette user exerting an increased axial force on a push button when it is desired to move the piston beyond the home position against the force of a return spring. The manual forces which a user of the pipette of U.S. Pat. No. 4,041,764 must exert on its pipette piston (plunger) in moving the piston from its upper stop position to and through a home position to a lower stop position are depicted in FIG. 4*b* herein.

The German patent applications, on the other hand, each describe a hollow piston pipette with ferromagnetic systems at upper and lower stops. The lower stop is a "hard" bottom stop for the hollow piston in that no piston movement beyond the lower stop is permitted. A user of the hollow piston pipette does not have to "feel" a "soft" stop defining a home position for the hollow piston. Rather, the lower stop defines the home position for the hollow piston pipette. Thus, in the operation of the hollow piston pipette, the user simply grasps the pipette body and by exerting a downward thumb force on an activating knob drives the hollow piston to the lower stop. To aspirate liquid into a tip connected to a lower cone of the hollow piston pipette, the user simply releases the activating knob and allows a compression spring to move the hollow piston from the lower stop to the upper stop. The ferromagnetic systems of the upper and lower stops interact with a magnetized locking piece to control operation of a disk seal in opening and closing the aperture of the hollow piston. For example, since the retaining force of the ferromagnetic system of the lower stop is greater than that of the locking piece and the axial motion of the locking piece is limited by a stop, the disk seal lifts away from a flange on the hollow piston and frees the aperture of the hollow piston so that a first cylinder-piston system communicates with a lumen of the pipette tip through the hollow piston and holes leading to a ventilation channel to atmosphere.

It is to be noted that in all of the foregoing manual pipettes, the pipette user is required to continuously apply steady downward force with his or her thumb to maintain the pipette plunger unit in its home position ready for insertion of a tip of the pipette into the liquid to be drawn into the tip by controlled upward movement of the plunger unit from the home position to its upper stop position.

Recognizing the physical and mental strain associated with repeated and prolonged operation of a manual pipette by a pipette user and to significantly reduce the physical and mental strain associated with the operation of manual pipettes and eliminate the need for the pipette user to physically maintain a pipette plunger in a home position, a latch mechanism operable as a pipette plunger reaches the home position has been recently developed and is described and illustrated in U.S. Pat. No. 5,364,596 assigned to the assignee of the present invention. As described in U.S. Pat. No. 5,364,596, the latch mechanism releasably maintains a plunger in the home position without any user exerted force on the plunger in opposition to the force of the return spring. Such an improved manual pipette may further include a velocity governor for automatically controlling the rate of return movement of the piston from the home position to the upper stop position for the plunger upon a release of the latch mechanism.

While such improved manual pipettes including latch and velocity governors improve the repeatability and reliability of operation of manual pipettes and reduce the physical and mental strain on pipette users where repeatability of operation is essential, they introduce significant increases in the manufacturing costs for manual pipettes which are reflected in increased prices for such improved manual pipette over their more simple predecessors.

More recently, an improved manual pipette which is of simple construction and low in manufacturing cost has been developed which provides a significant reduction in the physical and mental strain on a pipette user over the course of a series of pipette operations where repeatability of operation is essential. That manual pipette is described and illustrated in U.S. Pat. No. 5,700,959 assigned to the assignee of the present invention.

As previously stated, in prior conventional manual pipettes, the pipette user must exert a relatively strong downward thumb force on the plunger unit to retain it in the "home" position in opposition the return spring and a relatively strong "blow out" spring defining the "soft" stop. With the manual pipette described in the '959 patent however, rather than requiring the user to carefully sense the exact start of a sudden increase in a force opposing downward movement of a plunger unit in locating the "home" position for the plunger unit and rather than requiring the user to manually exert a strong downward force to maintain the plunger unit in its "home" position against the return and blow out springs, the manual pipette of the '959 patent includes a magnet assist mechanism. The magnet assist mechanism generates a downward magnetic force in opposition to the return spring force as the unit reaches and is at the home position. The magnetic force is less than the upward force generated by the return spring and does not latch the plunger unit at the home position as is the '596 patent. Rather, the opposition force generated by the magnet assist is (i) reflected in a reduction in the downward force required to move the plunger unit as it approaches the home position to aid the pipette user in sensing the home position, and (ii) reduces the manual force that the pipette user must exert to maintain the plunger unit in the home position. The magnet assist thereby substantially reduces the physical and mental strain on the pipette user over the course of a series of pipette operations wherein repeatability of operation is essential.

While the magnet assist mechanism described in the '959 patent is simple in construction, low in cost and significantly reduces the problems associated with conventional manual pipettes with respect to physical and mental strain, some pipette users have expressed the desire to be able to exercise complete manual control over the travel of the plunger particularly in the region of its axial travel where the magnet assist mechanism is operational to aide in locating and maintaining the pipette plunger at its "home position". The present invention not only satisfies that request but also provides a manual pipette which does not require or utilize a blow out spring or a latch mechanism to define the "home position" for the plunger unit.

SUMMARY OF INVENTION

Like prior conventional manual pipettes, the present invention comprises a hand holdable pipette body having a return spring biased plunger unit supported therein for axial movement from a first or upper stop position. As with prior manual pipettes, a pipette user holding the pipette of the present invention presses on a plunger control knob to move the plunger unit downward from the first stop position against the upward force of the return spring to a second or lower stop position wherein all fluid contained in a pipette tip secured to the pipette body is expelled from the tip. The pipette user then allows the return spring to return the plunger to a "home" position adjacent the lower stop position. The "home" position is defined by a "soft" stop and is the starting position to which the plunger unit is returned for the start of each successive aspiration operation with the pipette. In prior conventional manual pipettes, the pipette user must exert a relatively strong downward thumb force on the plunger unit to retain it in the "home" position in opposition the return spring and a relatively strong "blow out" spring defining the "soft" stop. In particular, any downward movement of the plunger unit beyond the "home" position activates the "blow out" spring which generates a strong upward force in opposition to such downward movement of the plunger unit. The pipette user senses or "feels" the start of the increase in the return force which provides the user an indication that the plunger unit has reached and is at the "home" position.

The pipette of the present invention, however, does not include a blow out spring. Further, with the present invention, rather than requiring the user to carefully sense the exact start of a sudden increase in a force opposing downward movement of a plunger unit in locating the "home" position for the plunger unit and rather than requiring the user to manually exert a strong downward force to maintain the plunger unit in its "home" position against a return spring and a blow out spring, the pipette of the present invention includes a mechanical assist mechanism. As the plunger unit reaches and is at the home position, the mechanical assist mechanism generates a lateral force which is translated by the plunger into a mechanical force in opposition to the return spring force. The mechanical opposition force is less than the upward force generated by the return spring and is reflected in a relatively small change in the downward force required to move the plunger unit as it approaches the home position and aids the pipette user in sensing the home position. Further, the opposition force generated by the mechanical assist reduces the manual force that the pipette user must exert to maintain the plunger unit in the home position. The mechanical assist thereby substantially reduces the physical and mental strain on the pipette user over the course of a series of pipette operations wherein repeatability of operation is essential.

Still further, the absence of a blow out spring in the pipette of the present invention means that a major operating force associated with all prior commercially available air displacement pipettes is eliminated in the present invention. That is, the large user generated downward force required to effect "blow out" of all liquid from the tip of the pipette in opposition to the strong blow out spring common in commercial air displacement pipettes. Thus, using a simple relatively low cost construction which eliminates the blow out spring common to air displacement pipettes, the present invention significantly reduces the problems associated with conventional manual pipettes with respect to physical and mental strain with only a minor increase in manufacturing cost.

BRIEF DESCRIPTION OF DRAWINGS

FIG. 4*a* depicts the actuating force associated with a standard manual pipette.

DETAILED DESCRIPTION OF INVENTION

Figure 1:
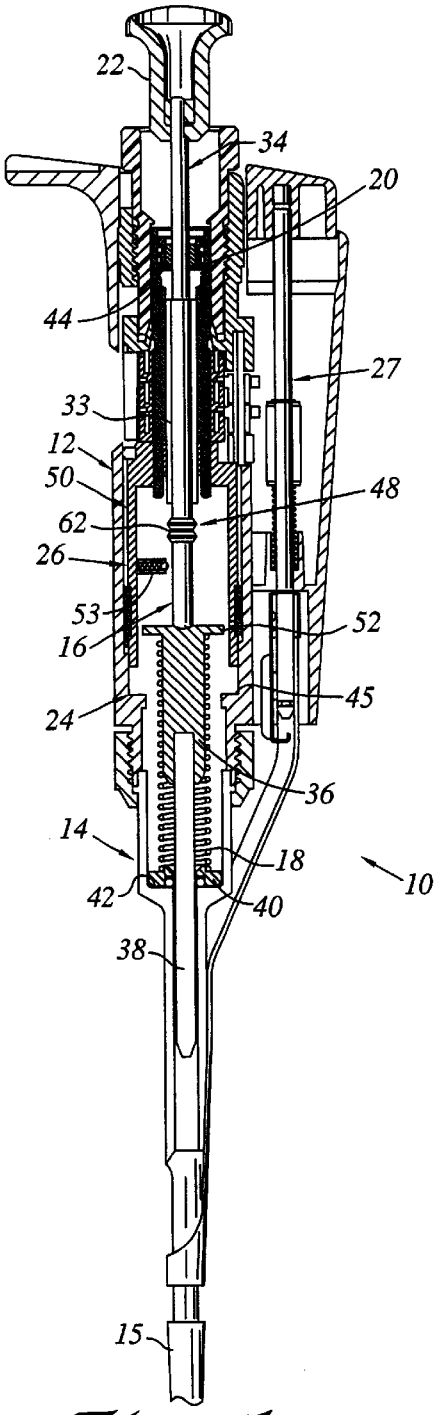
FIG. 1 is a side view of a manual air displacement pipette, partially in section, and including one form of the mechanical assist of the present invention. The manual pipette is illustrated at a position just below the upper stop or start position for a plunger unit included in the pipette.
Figure 2:
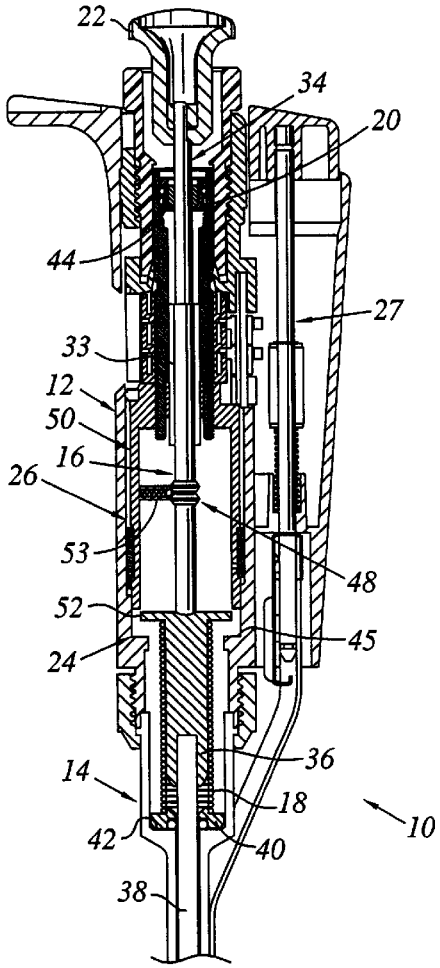
FIG. 2 is a fragmentary side view of the manual pipette of FIG. 1 showing the plunger unit at its home position with the mechanical assist operative to aide a pipette user in maintaining the plunger unit at the home position.

Referring to FIGS. 1 and 2, a preferred form of the manual air displacement pipette of the present invention is illustrated and represented by the numeral 10. The pipette 10 comprises a pipette body 12 preferably formed from a plastic material. The body 12 is axially elongated and shaped to be hand holdable with a liquid end 14 contiguous with and extending axially from a lower end of the body 12 to receive a disposable pipette tip 15. A plunger unit 16, upwardly biased by a return spring 18, is supported for axial movement within the pipette body 12 between an upper stop 20 and a lower stop 24. At the upper stop 20, an upper end of an enlarged portion 33 of a plunger 34 of the plunger unit 16 engages the upper stop with an end portion of the plunger unit 16 extending from an upper end of the pipette body 12 to receive a control knob 22. The body 12 and control knob 22 are shaped such that when a pipette user grips the body 12, his or her thumb extends over the top of the control knob such that thumb action of the user will exert a downward force on the plunger unit 16 to move the plunger unit downward from the upper stop 20 against the action of the spring 18 to the lower stop 24. At the lower stop 24, a bottom stop member 36 moveable with the plunger unit 16 engages an annular shoulder 45 within the pipette body 12 and defines the lower stop to limit further downward movement of the plunger unit within the pipette body.

Also located within the pipette body 12 is a mechanical assist mechanism 26 for aiding in (i) locating the "home" position of the plunger unit 16 and (ii) holding the plunger unit at a "home" position against the continuous upward spring bias of the return spring 18.

Parenthetically, the "home" position is the axial position of the plunger unit 16 in the pipette body 12 where the pipette 10 is ready for its tip 15 to be immersed in a liquid for pickup by the pipette 10 and subsequent dispensing into a receptacle. It is also the return position for the plunger unit 16 during repeated pipette operations in drawing liquid into and dispensing liquid from a series of disposable tips such as the tip 15. In that regard, the pipette 10 includes a pipette tip ejector 27 such as the improved ejector described in U.S. Pat. No. 5,614,153 issued Mar. 25, 1997 and assigned to the assignee of the present invention. As is common practice in the pipeting of liquids, following each pipette operation, the disposable tip is ejected from the pipette and replaced with a new tip to insure against contamination of the series of liquids samples dispensed by the pipette.

Figure 3:
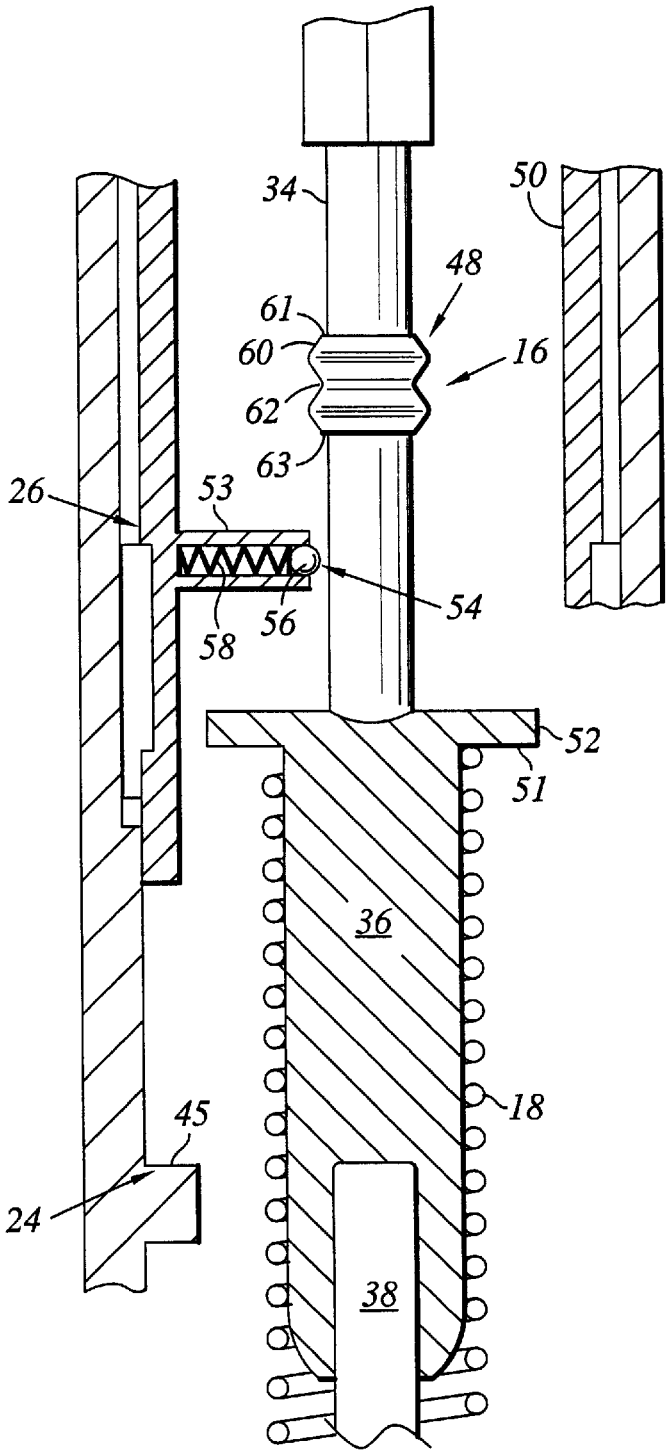
FIG. 3 is an enlarged cross-sectional side view of the mechanical assist illustrated in FIGS. 1 and 2.

As represented in FIGS. 1, 2 and 3, the mechanical assist mechanism 26 is designed to generate a counter force to the upward force of the return spring 18. The counter force is less than the upward force generated by the return spring. In this regard, as the piston unit 16 approaches its "home" position in the illustrated version of the mechanical assist 26, the counter force preferably is sensed by the pipette user as a slight increase and then a reduction in the downward manual hand force which must be exerted to move the piston unit. Alternatively, the counter force may be sensed as a slight reduction or increase in the downward manual force moving the piston unit. Any of foregoing forces sensed by the pipette user signals the user of the approach of the "home" position and aids in the exact locating of the home position. Further, the counter force generated by the mechanical assist 26 substantially reduces the manual hand force which must be generated by the pipette user to maintain the plunger unit 16 at the home position ready for aspiration of liquid into the pipette tip 15 during repeated operations with the pipette. Still further, since the counter force generated by the mechanical assist mechanism 26 is less than the upward force generated by the return spring 18, the pipette user maintains manual control over the position of the plunger unit 16 within the pipette body 12 both at the home position for the plunger unit 16 as well as during the initial upward movement of the plunger unit from the home position toward the upper stop position. After the initial movement of the piston unit 16 from the home position either in an upward or downward direction, the plunger is free of influence of the mechanical assist mechanism 26 and is only subjected to the upward influence of the return spring 18, since the manual pipette of the present invention does not incorporate a blow out spring. This means that the pipette user maintains complete control over the rate of upward movement of the plunger unit during aspiration of the liquid into the pipette tip 15. Accordingly, it is much easier for the pipette user to (i) maintain the pipette plunger at the exact same home position during a series of aspiration operations and (ii) allow the plunger unit to return to the upper stop position at the same velocity profile during successive aspiration operations with the manual pipette.

Figure 4A:
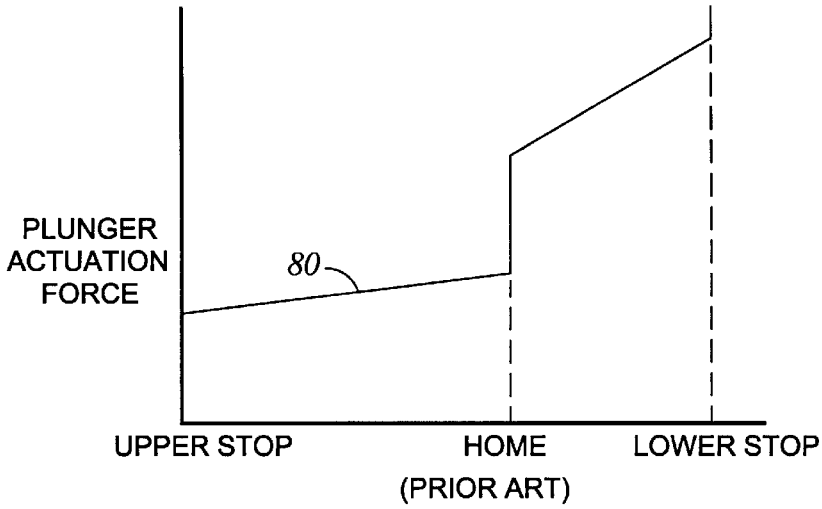
FIGS. 4*a, b* and *c* are graphs depicting the magnitude of the actuating force which a pipette user must exert on a plunger unit in moving the plunger unit from its upper stop to its home position and then to its lower stop position.
Figure 4B:
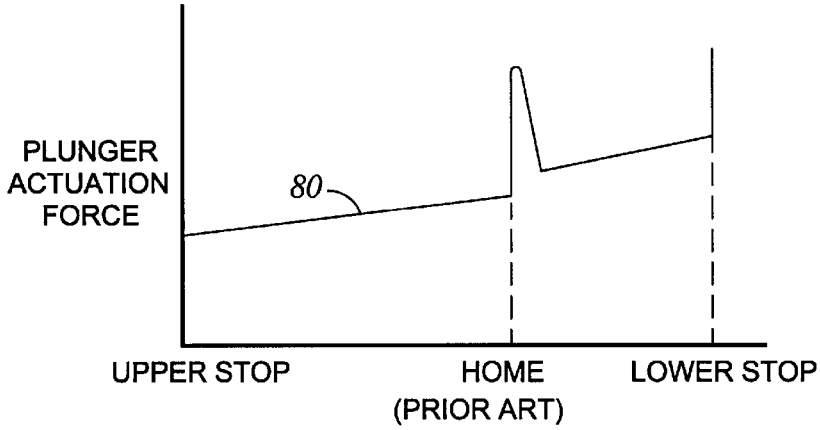
FIG. 4*b* depicts the actuating force associated with the pipette described in U.S. Pat. No. 4,041,764.
Figure 4C:
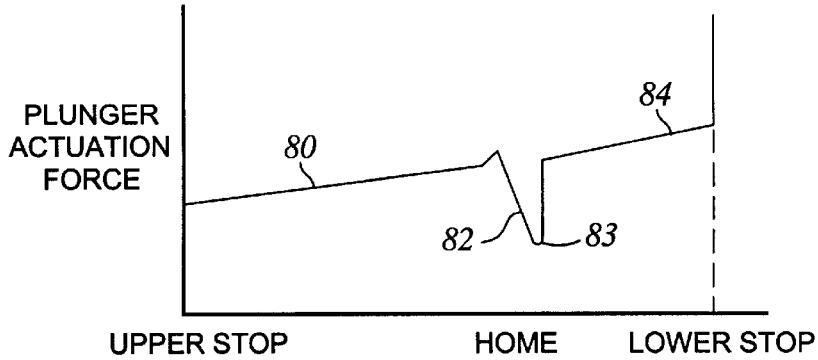
FIG. 4*c* depicts the actuating forces associated with the manual pipette with the mechanical assist of the present invention illustrated in FIGS. 1 and 2.

The above-described regulation of the manual force which the pipette user is required to generate in operating the manual pipette of the present invention including the mechanical assist 26 illustrated in FIGS. 1–3 is depicted in FIG. 4*c*. The advantages afforded by the present invention may be appreciated by a comparison of FIG. 4*c* with the graphs of FIGS. 4*a* and 4*b* depicting the plunger unit activation forces associated with prior art manual pipettes including "soft" stops defining a "home" position. As depicted in FIG. 4*c*, as the plunger unit in the manual pipette of the present invention is moved from its upper stop position, the manual force which the pipette user must generate is that which is required to overcome the return spring 18 and is depicted at 80 in each of FIGS. 4*a*, 4*b* and 4*c*. However, as the plunger unit in the manual pipette of the present invention approaches its home position, the mechanical assist 26 illustrated in FIGS. 1–3 generates a controlled counter force which is reflected first as a slight and gradual increase in the manual force followed by a slight and gradual reduction in the manual force 80 as shown at 82 until the "home" position is reached. To maintain the plunger unit at the "home" position the pipette user needs only exert the reduced force indicated at 83. Only then, and only if the pipette user desires to effect a "blow out" of liquid in the tip of the pipette 10 is the user required to exert an increased downward force as shown at 84 in opposition to the return spring 18. However, as indicated above, since the manual pipette of the present invention does not include a blow out spring, the only element of the manual pipette 10 exerting an upward force on the piston unit 16 as it travels downward from the home position is the return spring 18. This means that the manual force which is generated by the user of the pipette 10 of the present invention in effecting blow out is a downward manual force which slightly exceeds the upward force generated by the return spring. That downward manual force is depicted at 84 and is substantially less that the downward manual force required to effect blow out in a conventional manual pipette as depicted in FIG. 4*a*. Thus, FIG. 4*c* clearly reflects (1) the reduction in the manual force on the plunger unit which signals the pipette user of the approach of the "home" position, (2) the reduction in the manual force required to maintain the plunger unit at the home position as compared to the operation of the prior art manual pipettes depicted in FIGS. 4*a* and 4*b* and (3) the significant reduction in the manual force which a user of the pipette of the present invention is required generate to effect blow out.

Referring more specifically to FIGS. 1 and 2, the plunger unit 16 comprises axially elongated plunger 34 terminating at its upper end in the control knob 22 and at its lower end in the bottom stop member 36. The member 36 is secured to the upper end of a piston 38 moveable axially with the plunger 34 within the liquid end 14. The return spring 18 surrounds the piston 38 with an upper end bearing on an underside 51 of an annular flange 52 extending outwardly from an upper end of the bottom stop member 36 and a lower end bearing on a seal retainer 40 for a fluid tight seal 41 seated on a shoulder 42 inside the liquid end 14 around the piston 38. Thus confined, the return spring 18 continuously exerts an upward force on the piston 38, the member 36 and hence the plunger 34 to continuously urge the plunger unit 16 upward toward the upper stop 20, the upper stop being defined by an axially adjustable shoulder 44 within the body 12 of the pipette.

As illustrated most clearly in FIGS. 1 and 2, the bottom stop position for the plunger unit 16 in the pipette 10 is defined by the annular flange 52 at a top of the bottom stop member 36 which is designed to engage the shoulder 45 defining the lower stop 24 as the plunger unit is moved downward in response to downward manual force exerted by the pipette user on the push button 22.

Likewise, FIGS. 1–3 most clearly illustrate that for the pipette 10, the "home" position for the plunger unit 16 is defined by the mechanical assist 26. In that regard, the illustrated version of the mechanical assist 26 comprises cam 48 and a cam follower 54. The cam 48 is located on the plunger 34 below the enlarged portion 33 thereof while the cam follower 54 is secured to a inner sidewall of a cylinder 50 secured to the housing 12 and axially receiving the plunger unit 16. In FIGS. 1–3, the illustrated version of the cam follower 54 comprises a spring loaded ball 56 mounted and captured within in a tubular housing 58 extending inwardly from the cylinder 50 toward the plunger 34. An outer surface of the ball 56 is exposed to and normally spaced from the plunger 34. However, as the plunger 38 is depressed by the pipette user during dispensing of liquid from the pipette, the ball will engage and ride over the cam 48. As this occurs, the spring biased ball 56 exerts a lateral force on the plunger 34 which is reflected as depicted in FIG. 4*c* as a change in the plunger actuation force providing the user with the indication that the plunger is approaching and has arrived at the "home" position as previously described. Specifically, the illustrated version of the cam 48 comprises an annular sleeve member 60 which from an upper end 61 gradually increases and then decreases in annular thickness to form an annular depression 62 and then again gradually increases and decreases in annular thickness terminating at a lower end 63 of the sleeve. The ball 56 riding into the annular depression 62 provides the user with the indication that the plunger is in its above-described "home" position.

Figure 5A:
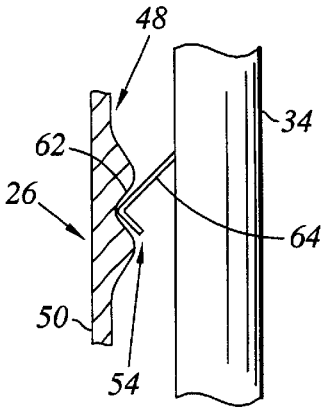
FIGS. 5*a*, 5*b*, 5*c*, 5*d* and 5*e* are diagrammatic enlarged sectional side views similar to FIG. 3 illustrating different versions of the mechanical assist which may be included in the manual pipette of the present invention.
Figure 5B:
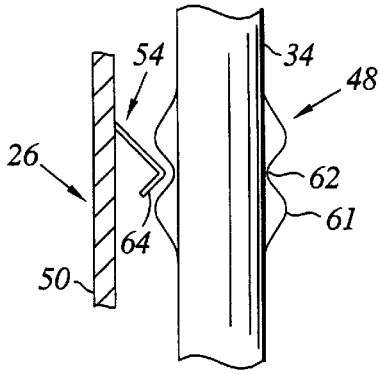

FIGS. 5*a*, 5*b*, 5*c*, 5*d* and 5*e* diagrammatically illustrate different embodiments of the mechanical assist mechanism 26. In FIG. 5*a*, the cam follower 50 is in the form a leaf spring member 64 carried by the plunger 34 for engaging the cam 48 secured to or forming an inside of the cylinder 50 and having an inner surface like the sleeve 61. In FIG. 5*b*, the cam follower 50 in the form the leaf spring member 64 is secured to the inside of the cylinder 50 to engage the surface of the cam 48 comprising the sleeve 61 as previously described. In both embodiments, the leaf spring 64 riding on the surface 61 including the depression 62 generates a lateral force on the plunger 34 which is reflected as changes in the downward plunger force providing the user of the pipette of the present invention with an indication of the approach of and arrival of the plunger at the "home" position.

Figure 5C:
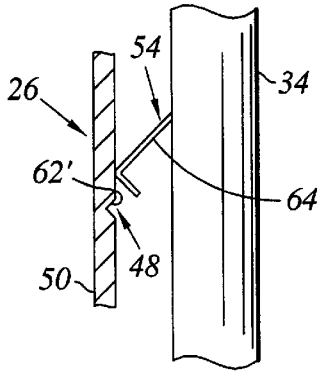
Figure 5D:
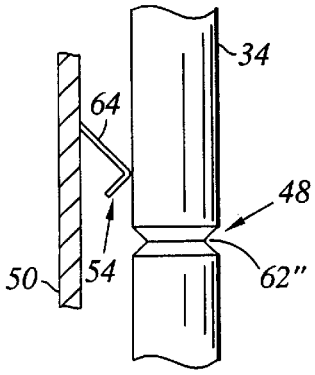
Figure 5E:
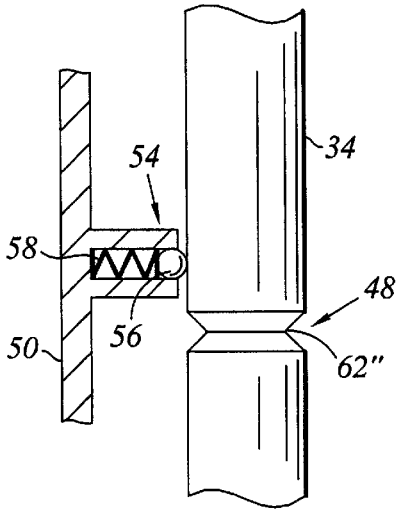

In FIGS. 5*c*, 5*d* and 5*e*, the mechanical assist mechanisms 26 comprise detent mechanisms resembling somewhat the cam and cam follower structures of FIGS. 5*a* and 5*b*. In each illustrated detent mechanism, a spring loaded member extending either the plunger 34 or cylinder 50 rides on the other to exert a lateral force thereon and ride into and out of a depression defining the "home" position for the plunger in the associated pipette. In FIG. 5*c*, the leaf spring 64 extends from the plunger 34 to ride on the cylinder into a depression 62' while in FIG. 5*d*, the leaf spring 64 extends from the cylinder to ride on the plunger and into an annular depression 62". In FIG. 5*e*, the previously described and illustrated (FIG. 3) spring loaded ball 56 rides on the surface of the piston into the depression 62".

While differing in detail, in each embodiment of the mechanical assist mechanism 26, the user is assisted in locating and maintaining the plunger in the "home" position as previously described.

While particularly preferred embodiments of the present invention has been illustrated and described herein above, it is to be appreciated that changes and modifications may be made in the preferred embodiment without departing from the spirit of the present invention. Accordingly, the present invention is to be limited in its scope only by the following claims.

What is claimed is:

1. A manual pipette for repeatably aspirating and dispensing a predetermined quantity of liquid, comprising:

a hand holdable pipette body;

a plunger unit mounted within the pipette body for manual downward movement by a pipette user away from a first stop position through a home position to a second stop position, the home position being a predetermined starting position for the plunger unit for a repeatable aspiration of the predetermined quantity of liquid into a tip extending from the pipette body when the tip is immersed in the liquid and the second stop position being an end position for the plunger unit at which substantially all liquid is dispensed by the pipette from the tip;

a return spring within the pipette body for generating an upward force opposing downward movement of the plunger unit away from the first stop position and for returning the plunger unit to the first stop position; and a mechanical assist mechanism operative only as the plunger unit reaches the home position for generating a downward mechanical force opposing and less than the upward force of the return spring to aid the pipette user in locating and, without locking, maintaining the plunger unit at the home position and under continuous control of the pipette user.

2. The pipette of claim 1 wherein the mechanical assist mechanism comprises a member secured to the plunger unit or housing for riding into a depression in the other to exert a lateral force on the plunger.

3. The pipette of claim 2 wherein the mechanical assist mechanism comprises a cam and a cam follower.

4. The pipette of claim 2 wherein the mechanical assist mechanism comprises a mechanical detent mechanism.

5. The pipette of claim 1 wherein the pipette is free of a blow out spring and the return spring is the only spring within the pipette which exerts an upward force on the plunger unit between the home position and the second stop position.

* * * * *